US007111529B2

(12) United States Patent
Pradelski

(10) Patent No.: US 7,111,529 B2
(45) Date of Patent: Sep. 26, 2006

(54) RATCHETABLE OPEN-ENDED WRENCH

(76) Inventor: William W. Pradelski, 1463 Kansas St., Frankfort, IL (US) 60423

( * ) Notice: Subject to any disclaimer, the term of this patent is extended or adjusted under 35 U.S.C. 154(b) by 0 days.

(21) Appl. No.: 10/628,037

(22) Filed: Jul. 25, 2003

(65) Prior Publication Data

US 2005/0016334 A1 Jan. 27, 2005

(51) Int. Cl.
*B25B 13/12* (2006.01)

(52) U.S. Cl. ..... 81/179

(58) Field of Classification Search ..... 81/179, 81/186

See application file for complete search history.

(56) References Cited

U.S. PATENT DOCUMENTS

| | | | | |
|---|---|---|---|---|
| 2,730,000 A | | 1/1956 | Crittenden, Jr. | |
| 2,907,243 A | * | 10/1959 | MacLean | 81/179 |
| 3,023,654 A | | 3/1962 | Stambaugh et al. | |
| 3,165,015 A | | 1/1965 | Hinrichs | |
| 3,306,142 A | | 2/1967 | Buteau | |
| 3,695,125 A | * | 10/1972 | Glass et al. | 81/179 |
| 3,717,054 A | | 2/1973 | Thompson | |
| 4,139,959 A | | 2/1979 | Howard et al. | |
| 4,440,047 A | | 4/1984 | Robbins | |
| 4,637,284 A | | 1/1987 | Rosenbaum | |
| 4,672,549 A | | 6/1987 | Saxton | |
| 4,787,277 A | | 11/1988 | Myers | |
| 5,533,428 A | | 7/1996 | Pradelski | |
| 5,669,272 A | * | 9/1997 | Hansen | 81/179 |
| 5,706,687 A | | 1/1998 | Welsh et al. | |
| 5,780,797 A | | 7/1998 | Budnik | |
| 2003/0196525 A1 | * | 10/2003 | Huang | 81/179 |
| 2005/0016334 A1 | * | 1/2005 | Pradelski | 81/179 |

* cited by examiner

*Primary Examiner*—Lee D. Wilson
(74) *Attorney, Agent, or Firm*—Jansson, Shupe, Munger & Antaramian, Ltd.

(57) ABSTRACT

A ratchetable open-ended wrench having a slidable retractable jaw member in a slot in one of its jaws and having a cover plate, preferably two cover plates, welded to the jaw in a manner such that the cover plate forms a load-bearing structural member within the jaw.

6 Claims, 11 Drawing Sheets

PRIOR ART

RATCHETABLE OPEN-ENDED WRENCH

FIELD OF THE INVENTION

This invention is related to open-ended wrenches and, in particular, to ratchetable open-ended wrenches.

BACKGROUND OF THE INVENTION

Open-ended wrenches have numerous applications wherever any of various rotatable elements such as hexagonal nuts or bolts need to be tightened or loosened. The open-ended variety of wrench is especially useful where tight spaces restrict the use of socket wrenches or other closed-end tools. The difficulty with these wrenches, however, is that when the user is using it to turn an element in anything but the most unrestricted of spaces, the wrench must be removed from the rotatable element and repositioned every fraction of a turn due to interference with other obstructions. Thus, without adequate space for a full 360-degree turn of the handle, multiple turning strokes must be applied, with repositioning necessary after each stroke. This shortcoming slows the rate at which the rotatable element is driven or loosened, making it difficult and sometimes nearly impossible to turn rotatable elements quickly in tight or awkward spaces.

A number of ratchetable open-ended wrenches have been developed to surmount such shortcoming. Among various ratchetable open-ended wrenches, a particularly simple useful configuration is disclosed in U.S. Pat. No. 5,533,428 (Pradelski), which is commonly controlled with the present invention. The patent discloses a wrench utilizing only two moving parts, with one of such parts simply being a spring which pushes the other, a retractable jaw member, within a slot in one of the two fixed jaws of the open-ended wrench. The retractable jaw member of the aforementioned patent enables the wrench to rotate about the rotatable element in the direction opposite to the direction of applied torque. Thus, a series of sequential partial-turn strokes can be applied to a rotatable element without removing the wrench. Much of the reactive torque force is absorbed by the wrench jaw, as opposed to the more delicate parts of the ratcheting mechanism itself.

Notwithstanding the advances in ratchetable open-ended wrenches, there remain certain problems and a need for significant improvements in performance.

One problem relates to certain common misuse and abuse of open-ended wrenches. Such wrenches, including those of the ratcheting type, are frequently used in appropriately as hammers or crowbars, and in some cases extreme torque is applied in dealing with rotatable elements (nuts, bolts, etc.). These forms of misuse put excessive stress or impact loads on one of the jaws of the wrench. Therefore, it is important that the jaws of the wrench be as strong as possible in order to prevent failure. In ratchetable open-ended wrenches, such as those of the above-mentioned patent, jaws with reduced metal structure due to the need to achieve ratcheting action (by accommodating ratcheting members) are particularly susceptible to such failures.

Another problem in prior ratchetable open-ended wrenches is the fact that their ratcheting members sometimes tend to catch or hang up on burrs or other sharp irregularities on the rotatable elements. It is desirable that the rotation of the wrench in the direction opposite to the direction of applied torque be as free as possible.

Still another problem relates to dealing with worn rotatable elements—i.e., rotatable elements with worn corners between the flats. Certain ratchetable open-ended wrenches of the prior art provide contact area inadequate to apply sufficient torque to severely worn rotatable elements. A ratchetable open-ended wrench having improved engagement with severely worn rotatable elements would be a significant advance in the art.

OBJECTS OF THE INVENTION

It is an object of this invention is to provide an improved ratchetable open-ended wrench overcoming problems and shortcomings of the prior art.

Another object of this invention is to provide an improved ratchetable open-ended wrench that is able to withstand the rough abuse to which open-ended wrenches are subjected under normal use and abuse.

Another object of this invention is to provide an improved ratchetable open-ended wrench that is able to deliver higher levels of torque to rotatable elements without structural risks to the wrench.

Another object is to provide an improved ratchetable open-ended wrench that operates smoothly when being rotated in the backward (ratcheting) direction so as not to allow the wrench to slip of the rotatable element on sequential strokes.

Another object of this invention is to provide an improved ratchetable open-ended wrench that maximizes the useful contact area between its retractable jaw member and the rotatable element being turned.

Still another object of this invention is to provide an improved ratchetable open-ended wrench which is able to deliver torque more reliably to rotatable elements which are worn.

Yet another object of this invention is to provide an improved ratchetable open-ended wrench with an improved range of motion of its retractable jaw member.

Another object of this invention is to provide an improved compression spring of a configuration making it particularly favorable for use in ratchetable open-ended wrenches.

These and other objects will be apparent to those who become aware of the invention disclosed herein.

SUMMARY OF THE INVENTION

This invention is an improvement in ratchetable open-ended wrenches of the type having first and second jaws, a base area connecting the jaws, a retractable jaw member slidable within a slot in the second jaw and projecting toward the base area, and a first cover plate on a first side of the second jaw to limit the lateral movement of the retractable jaw member within the slot. The inventive improvement comprises welding the cover plate to the second jaw such that the cover plate forms a load-bearing structural member within the second jaw. In one embodiment of the improved wrench, the cover plate is welded to the second jaw on both sides of the slot.

The term "load-bearing structural member" used herein with respect to a welded cover plate describes the fact that when the cover plate is welded to a jaw of an open-ended wrench, it is able to carry some of the stress which is present in the jaw during use (intended or otherwise), thereby substantially increasing the strength of the jaw over that of a jaw which includes a cover plate used only as a cover.

In another embodiment of the improved wrench, the welds are projection-welds. Projection welding is a form of resistance welding wherein two metal parts are fused together by the heat produced by an electrical current passing through projections or embossments on one of the metal parts. More than one weld can be made at one time. The two parts are held together under pressure from the electrodes during the welding process, thereby enabling the welds to be closely controlled even when joining sheet-metal or other low-mass parts. The physical properties of the parts are thus preserved through the joining process.

In a preferred embodiment, a second cover plate is welded to a second side of the second jaw such that the cover plate forms a load-bearing structural member within the second jaw. The second cover plate also limits lateral movement of the retractable jaw member within the slot.

In a particularly preferred embodiment of the improved wrench, the cover plate is recessed in the second jaw such that the outer surface of the cover plate is substantially flush with the lateral surface of the second jaw.

In another preferred embodiment of the improved wrench, the retractable jaw member has an outer corner having a radius of at least 3% of the flat-to-flat dimension of the rotatable element for which the wrench is sized. Open-ended wrenches are sized according the sizes of the rotatable elements (e.g., hexagonal nut) for which they are intended. A ½" hexagonal nut measures ½" between opposite flat sides of its hexagonal shape, and this dimension is referred to herein as the flat-to-flat dimension.

In a highly preferred embodiment of the improved wrench, a full-compression oblong tapered coil spring, a spring of unique design, is included for biasing the retractable jaw member toward the base area.

In a highly preferred embodiment of the improved wrench, the retractable jaw member is in the shorter of the two jaws, rather than the longer; stated differently, in the context of jaw-member identification in this document, the second jaw (i.e., where the ratchetable jaw member is located) is shorter than the first jaw. This reduces the torque-related stresses within the material around the slot.

Another unique feature of the present invention is the nature of the coiled spring which is used to bias the movement of the retractable jaw member within the slot. The spring is a tapered coil spring in which each turn of the coil is oblong, thereby enabling the spring to substantially span the oblong cavity formed by the slot and the cover plates and maintaining the position and orientation of the spring within the slot cavity. Thus, the term "oblong tapered coil spring" is used herein to describe a tapered coil spring (sometimes referred to a conical coil spring) in which each turn of the spring is oblong—i.e., generally of oval or racetrack shape rather than circular (the common configuration of tapered or conical coil springs).

The ratchetable open-ended wrenches of this invention provide important advantages over prior ratchetable open-ended wrenches, making the invention highly desirable for use in a wide variety of applications and increasing usage of tools of this type.

DETAILED DESCRIPTION OF PREFERRED EMBODIMENTS

Figure 1:
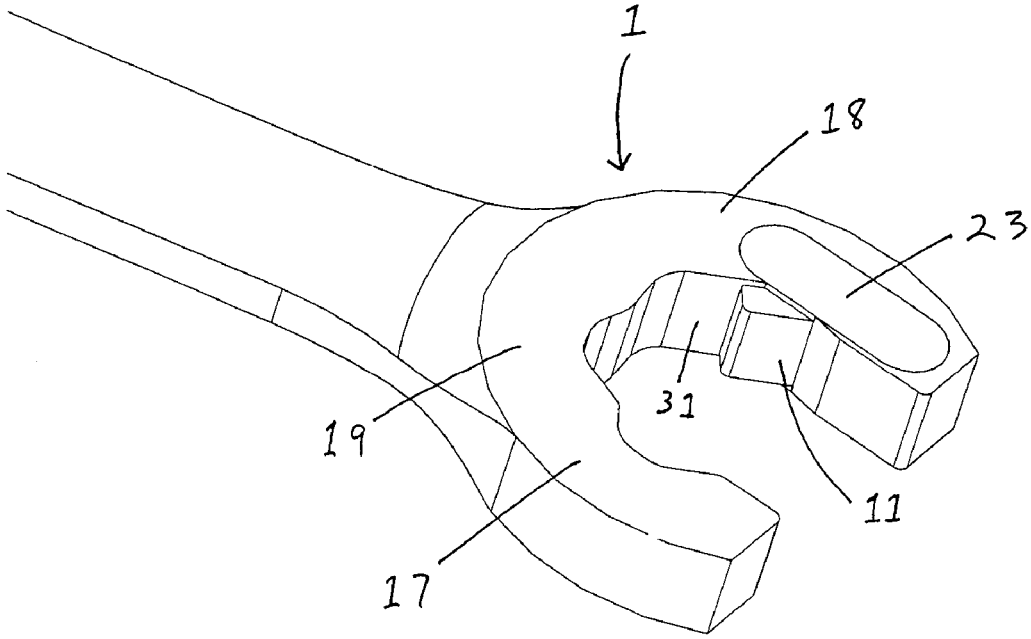
FIG. 1 is a full perspective view of the jaw end of one embodiment of the improved wrench.

FIG. 1 is a full perspective view of the jaw end of one embodiment of the improved ratchetable open-ended wrench 1. Wrench 1 in this embodiment has a first jaw 17 and a second jaw 18 connected by a base area 19. Wrench 1 further includes a retractable jaw member 11 that is slidable within a slot 21 (not shown in FIG. 1) along an axis of motion parallel to a support surface 31 of second jaw 18. Retractable jaw member 11 in FIG. 1 is shown in a fully-extended position with retractable jaw member 11 in its position closest to base area 19. A cover plate 23 is recessed into second jaw 18, thereby limiting the lateral movement of retractable jaw member 11 within slot 21 (not shown in FIG. 1). Cover plate 23 is welded to second jaw 18 in order to form a load-bearing structural member within second jaw 18. In certain preferred embodiments of the invention, a cover plate 25 (not shown in FIG. 1) is recessed into the opposing face of second jaw 18, serving the same functions as cover plate 23.

Figure 2:
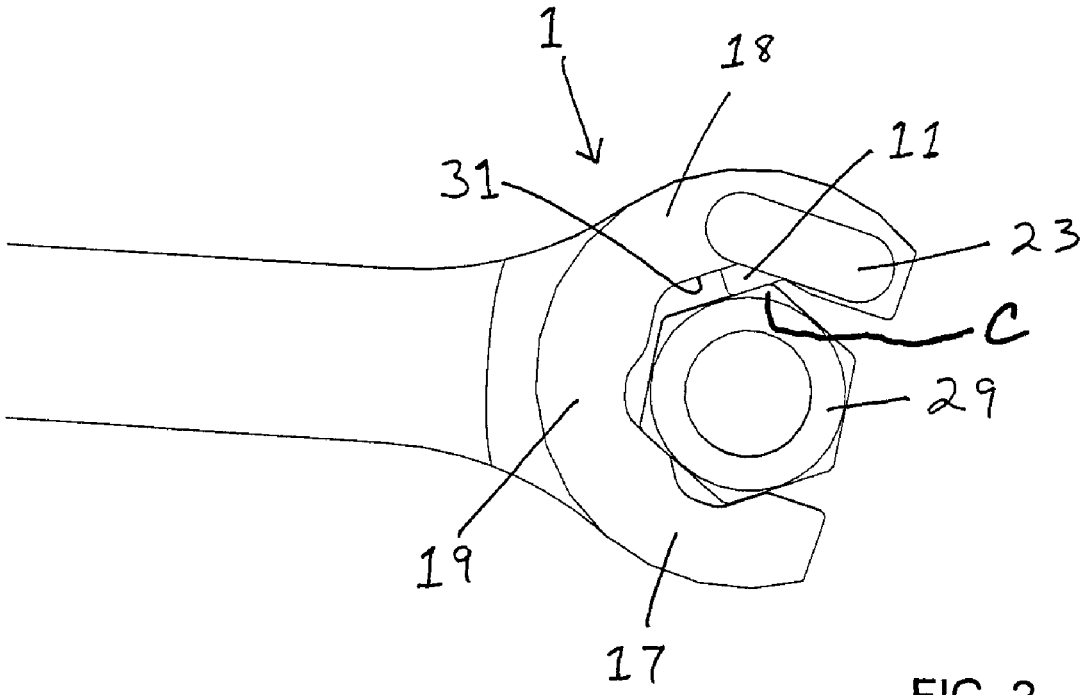
FIG. 2 is a front elevation of the jaw end of the wrench of FIG. 1.

FIG. 2 is a front elevation of the jaw end of wrench 1, further illustrating the basic configuration of wrench 1. FIG. 2 also illustrates the manner in which wrench 1 grips a rotatable element 29. Further details of the configuration and operation of wrench 1 will be described with reference to additional figures.

Figure 3:
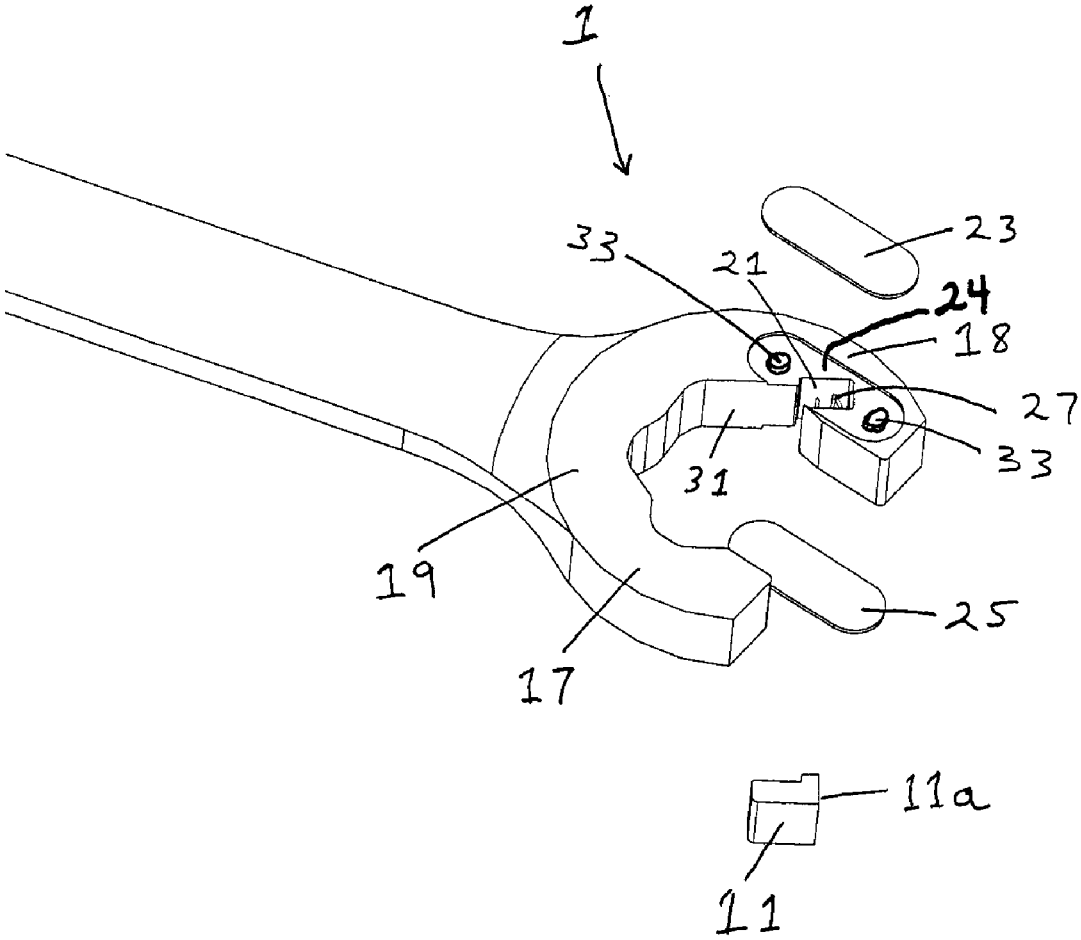
FIG. 3 is an exploded perspective view of the jaw end of the wrench of FIG. 1.

FIG. 3 is an exploded perspective view of the jaw end of wrench 1, illustrating the internal configuration of wrench 1. Retractable jaw member 11, shown at the bottom of FIG. 3, fits into slot 21 and is pushed toward base area 19 along support surface 31 by a full-compression oblong tapered coil spring 27 against surface 11*a*, thereby biasing retractable jaw member 11 toward base area 19. Cover plate 23 is welded to second jaw 18 in recess 24. In similar fashion, cover plate 25 is welded in a corresponding recess (not shown in FIG. 3) to the opposite side of second jaw 18. A preferred method of welding cover plates 23 and 25 to second jaw 18 is projection welding. The exploded view of FIG. 3 shows two projections 33 located within recess 24 of second jaw 18. Projections 33 as shown in FIG. 3 are in a pre-welded form. During the welding process, the metal of projections 33 flows between cover plate 23 and second jaw 18 to form welds over an area much larger than the area of projections 33 on second jaw 18. Thus, cover plates 23 and 25 welded to second jaw 18 enable cover plates 23 and 25 to become load-bearing structural members within second jaw 18, significantly strengthening second jaw 18.

While a passing reference is made in the "428 patent" to holding the cover plate in place by welding, there is no teaching of the cover plates in the prior art adding any structural integrity to the jaw of the prior art wrench. In the "428" patent, the cover plates encase the spring and a portion of the retractable jaw member and prevent the encased parts from falling out of the slot.

Figure 4A:
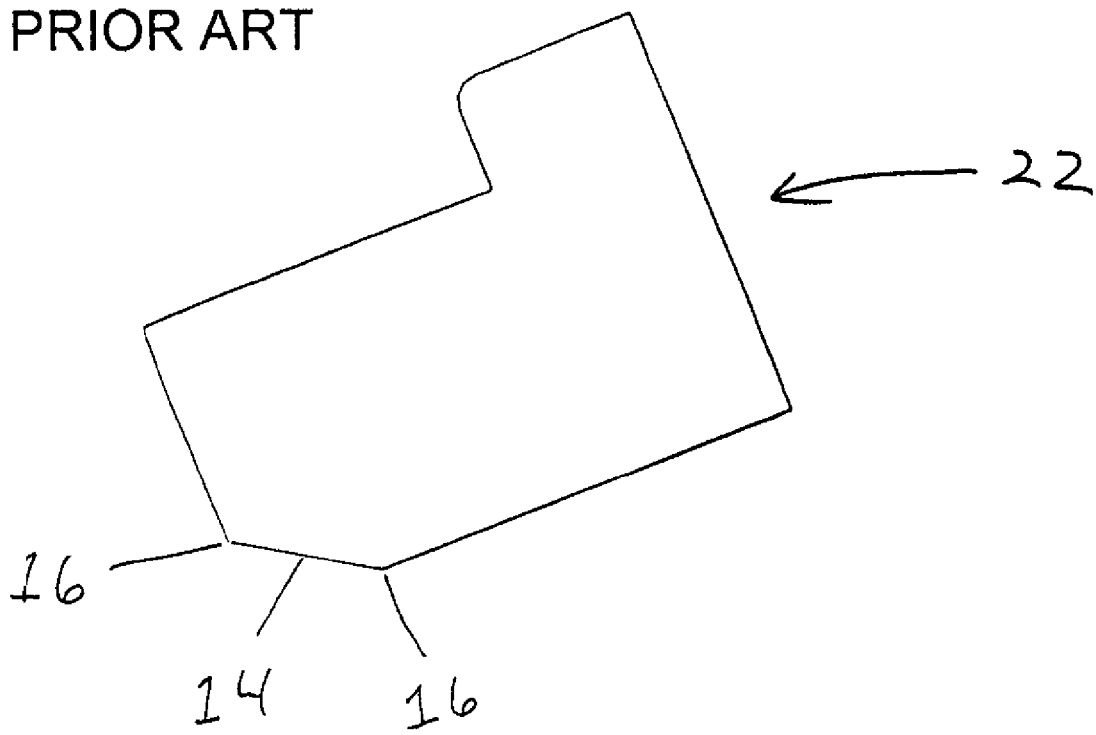
FIG. 4A is a front elevation of a retractable jaw member of the prior art.
Figure 4B:
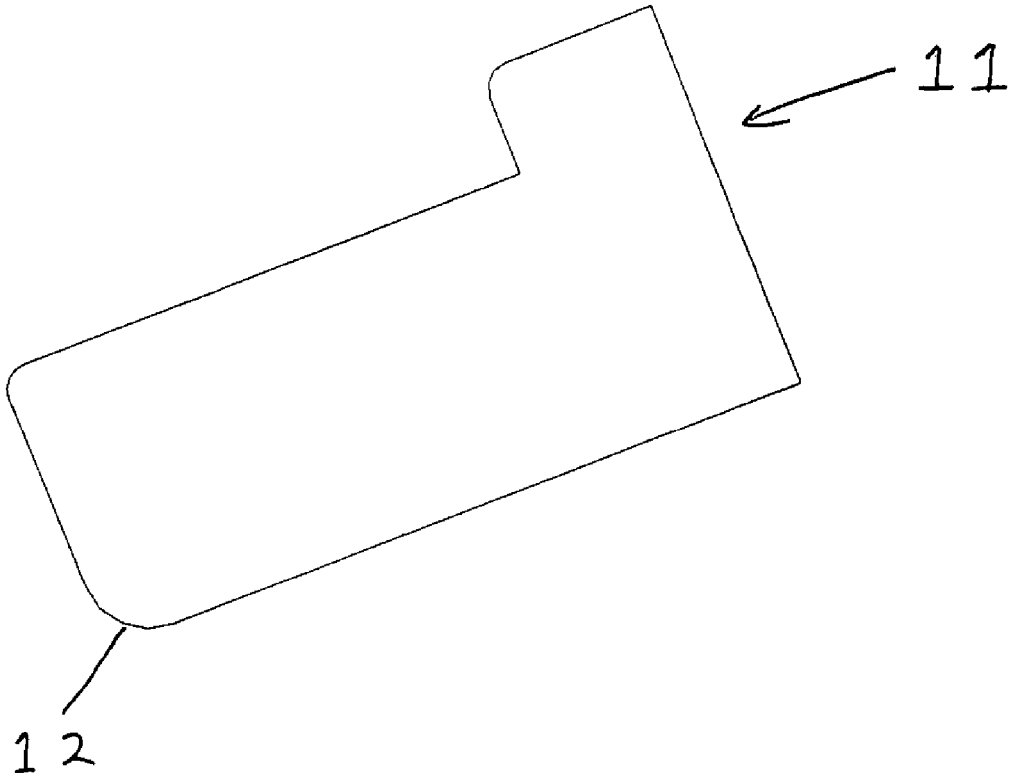
FIG. 4B is a front elevation of a retractable jaw member of the invention.

FIGS. 4A and 4B show enlarged front elevations of a prior art retractable jaw member 22 (FIG. 4A) and retractable jaw member 11 (FIG. 4B). The relative dimensions of jaw member 11 and jaw member 22 are approximately as shown in these figures. Prior art retractable jaw member 22 has a chamfered outer corner 14 which contains sharp corners 16. Retractable jaw member 22 has a radiused outer corner 12 with a radius of at least 3% of the flat-to-flat dimension of the rotatable element for which the wrench is sized. During a ratcheting action (wrench 1 being rotated in the direction opposite to the applied torque), sharp corners 16 of outer corner 14 of prior art retractable jaw member 22 catch or hang up on burrs found on the corners of worn rotatable elements, such burrs typically having been caused by tool gouging (of pliers, channel locks, vice grips, etc.). Forming radiused corner 12 in retractable jaw member 11 virtually eliminates such catching or hanging up.

Typically, although not a hard-and-fast rule, the size of burrs found on worn rotatable elements are roughly proportional to the size of the rotatable element on which they are found; i.e., the burrs on large rotatable elements are larger than those found on smaller rotatable elements. Because of this, reliable ratcheting motion is achieved by sizing the radius of radiused outer corner 12 to be proportional to the size of the rotatable element for which the wrench is sized. If the radius of radiused outer corner 12 is too small, catching or hanging up on burrs can occur more easily. If the radius of radiused outer corner 12 is too large, the contact area available for applying torque to the rotatable element is decreased, thereby limiting the use of the wrench to turning rotatable elements with a lesser degree or wear.

Figure 5:
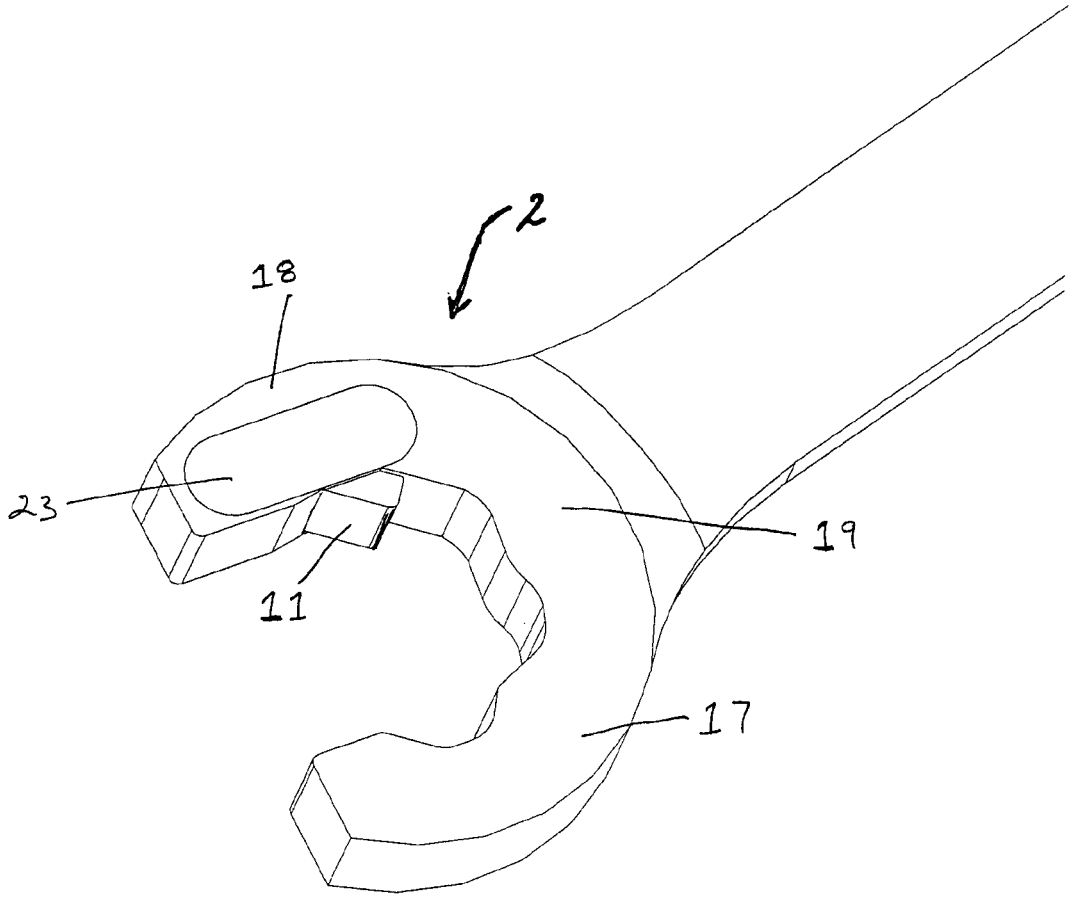
FIG. 5 is a full perspective view of the jaw end of a preferred embodiment of the improved wrench.

FIG. 5 is a full perspective view of the jaw end of a preferred embodiment of the invention. Often although not in every case, open-ended wrenches generally are configured so that the two jaws of the wrench are of different lengths, enabling the wrench to be used in a wider range of tight situations. Wrench 2 in FIG. 5 includes a further improvement of retractable jaw member 11 being in the shorter of the two jaws. (For convenience in the description, in FIG. 5 second jaw 18 is the shorter of the first and second jaws. In proper use, stresses within second jaw 18 of wrench 2 in FIG. 5 are significantly lower than in wrenches in which the retractable jaw member is in the longer of the two jaws, due to the much shorter distance between the center of rotation of wrench 2 and the region around the slot (not visible in FIG. 5) in second jaw 18. This significantly lowers the possibility that high torques in proper use would cause a failure. Furthermore, given that "crowbar" misuse of open-ended wrenches using the shorter of the two jaws is almost impossible, breakage due to such misuse is dramatically reduced with the highly preferred embodiment illustrated in FIG. 5.

Figure 6A:
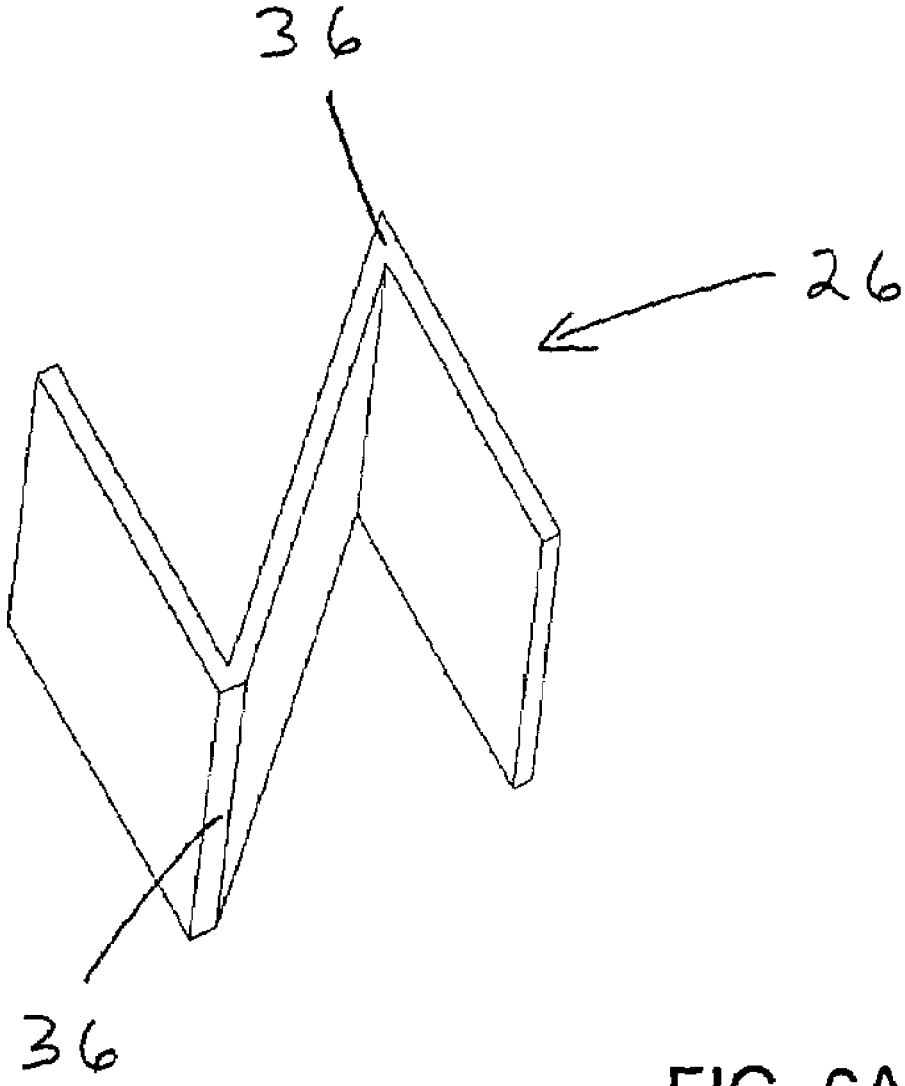
FIG. 6A is a perspective view of the spring of a ratchetable open-ended wrench of the prior art.
Figure 6B:
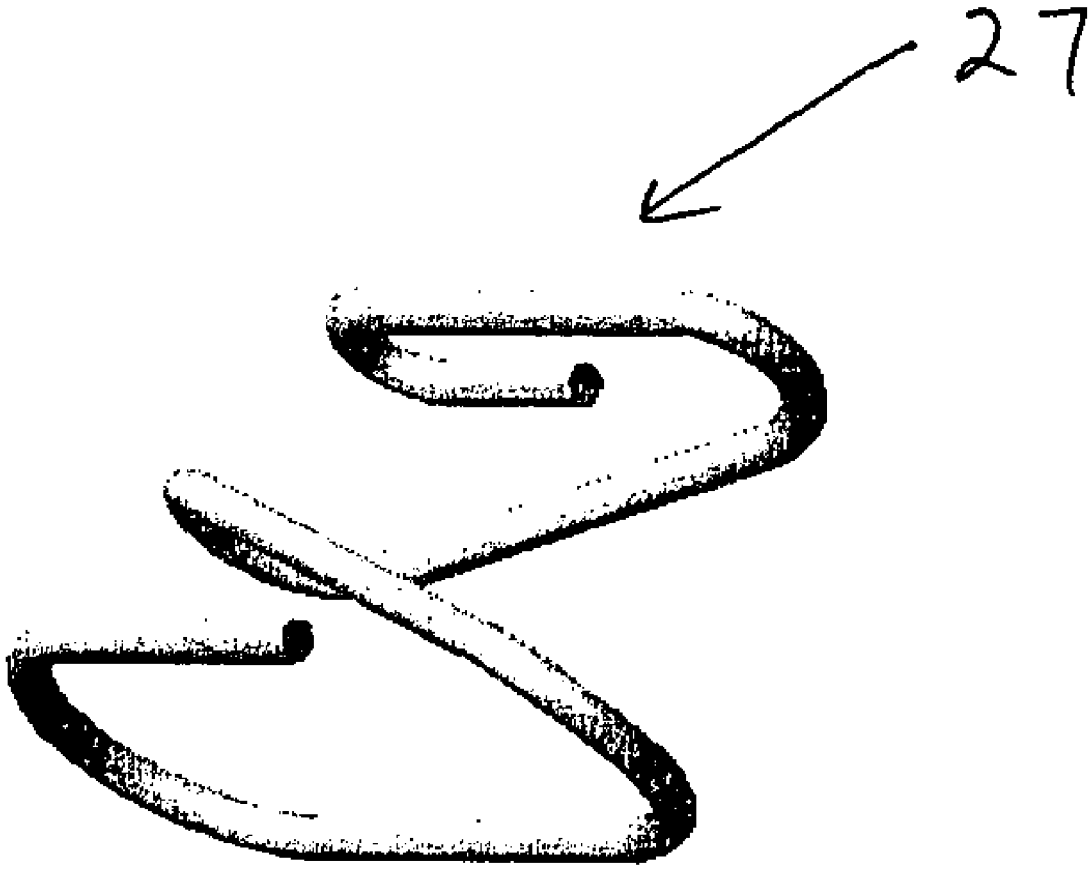
FIG. 6B is a perspective view of the full-compression oblong tapered coil spring of the improved ratchetable open-ended wrench of this invention.

FIGS. 6A and 6B show a comparison between a folded spring 26 used in a prior art ratchetable open-ended wrench and full-compression oblong tapered coil spring 27 of improved wrench 1. Folded spring 26, when fully compressed, has a thickness of about three thicknesses of the spring material used to form spring 26. Corners 36 of spring 26 prevent the full-compression thickness from being equal to three material thicknesses. In addition, the stresses in corners 36 can be extremely high under near-full-compression conditions and can cause breakage to occur at corners 36. Full-compression oblong tapered coil spring 27 of improved wrench 1, shown in FIG. 6B, eliminates these two limitations of spring 26. The tapered coil configuration allows spring 27 to compress to the thickness of a single spring wire diameter while not subjecting any portion of spring 27 to stresses which can cause breakage. The oblong configuration of spring 27 enables spring 27 to fit into slot 21 (shown in FIG. 3) by "filling" slot 21, thereby maintaining the position and orientation of spring 27 within slot 21.

Figure 7B:
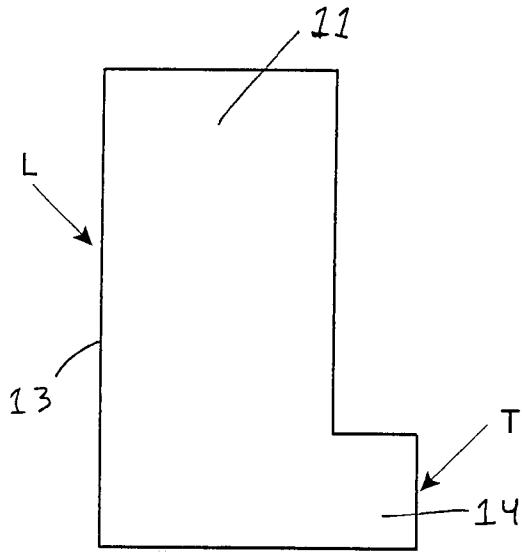
FIG. 7B PRIOR ART
FIGS. 7A and 7B are schematic drawings comparing the dimensions of a retractable jaw member of a wrench of the prior art (FIG. 7A) with the retractable jaw member of the improved wrench of this invention (FIG. 7B), the wrenches being for use with rotatable elements of one size.
Figure 7A:
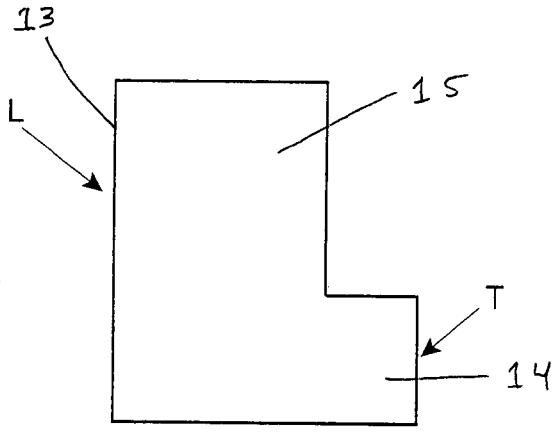

FIGS. 7A and 7B are simple schematic drawings illustrating the improved dimensions of retractable jaw member 11 as compared to prior art retractable jaw member 22. The table below presents the relevant dimensions for a wrench sized to turn 13/16" rotatable elements. Length L is the overall length of contact face 13 of retractable jaw members 11 and 15, and thickness T is the thickness of retractable jaw stops 14 of retractable jaw members 11 and 15, as indicated in FIGS. 7A and 7B. The table further shows the lengths of slots 21 in which retractable jaw members 11 and 15 respectively slide. These dimensions, along with the decreased fully-compressed thickness of spring 27, combine to yield more than a 200% increase in contact length against an unworn rotatable element and adds the maximum grip adjacent to the radius of the flat surface of the element. This provides improved performance with worn rotatable elements as further discussed below.

| Retractable jaw member dimensions (for 13/16") | Prior Art | Invention |
|---|---|---|
| Length L of retractable jaw member | 4.605 mm | 5.715 mm |
| Thickness T of retractable jaw member stop | 1.715 mm | 1.524 mm |
| Slot length for retractable jaw member and spring | 5.726 mm | 6.121 mm |
| Contact length on unworn nut | 1.270 mm | 3.910 mm |

Figure 8:
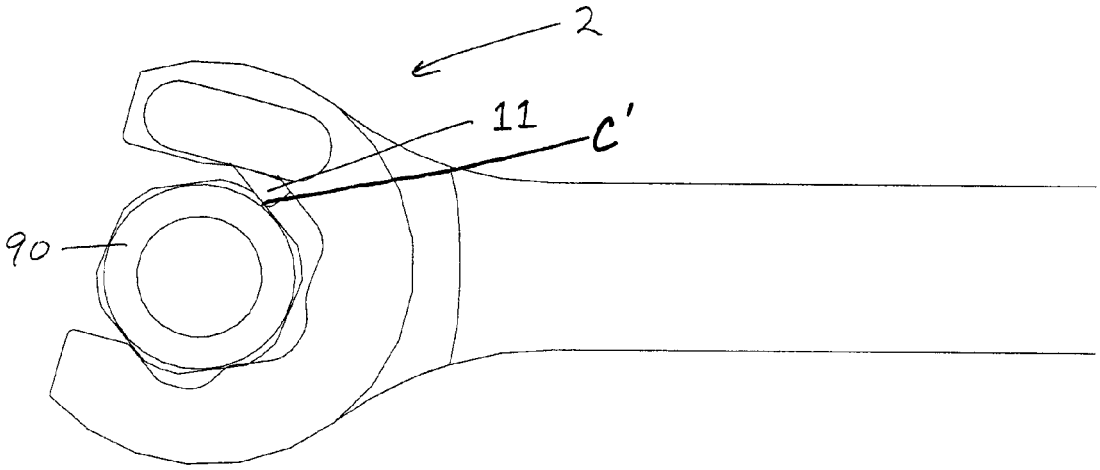
FIG. 8 is a front elevation view of this invention illustrating the increased contact area of the retractable jaw member on a worn nut that is achieved by the wrench of this invention.

FIG. 2 illustrates the improved performance which is provided by increased contact area C of the retractable jaw member against one of the flat surfaces of a rotatable element. The increased contact capability is particularly advantageous when the rotatable element is worm, and FIG. 8 depicts the situation when a worn nut 90 is being rotated. In can be seen that despite the wear there is a good contact area C' with the remaining flat surface of the worn nut. In a prior art ratchetable wrench as exampled in the table above, the contact area against severely worn nut 90 as shown would be essentially zero, rendering the wrench inoperative under such circumstances.

Figure 9A:
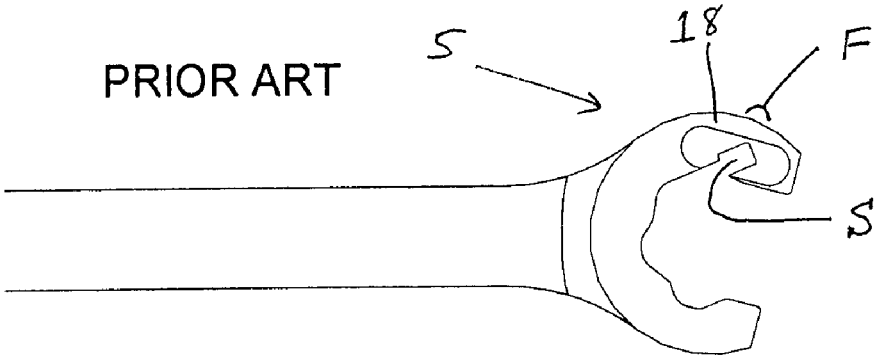
FIGS. 9A, 9B and 9C are front elevations of the jaw ends of the basic metal structure of three ratchetable open-ended wrenches of the prior art with all parts other than the basic metal structure removed. These drawings illustrate structural failures occurring in such wrenches.
Figure 9B:
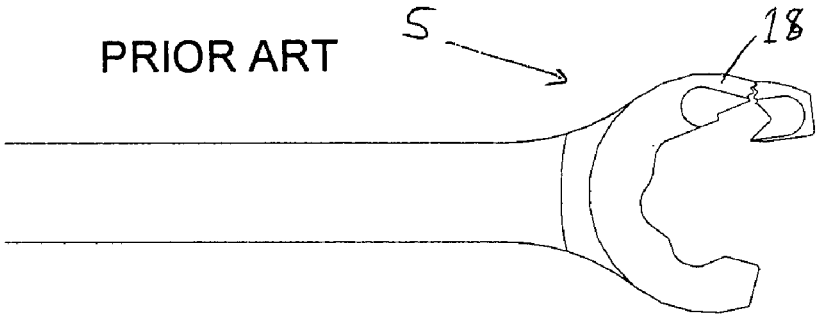
Figure 9C:
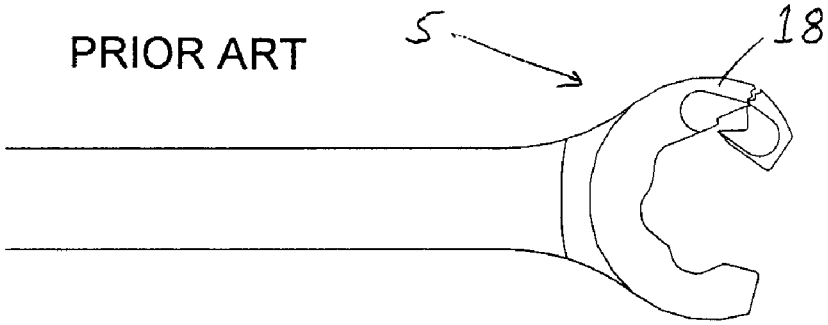

FIGS. 9A, 9B and 9C are front elevations of the jaw ends of the basic metal structure 5 of three ratchetable open-ended wrenches with all parts other than the basic metal structure removed. These figures illustrate major structural failures which can occur in the second jaw of wrenches of the prior art if the wrenches are used for purposes for which they are not intended or if "too much" torque is applied.

FIG. 9A shows basic structure 5 in a pre-failure mode. Slot S is shown. A failure region F of the second jaw is also shown to illustrate the region of the second jaw most likely to fail under misuse or in an "over-torqued" condition. Region S is identified as the region along the second jaw where slot S is closest to the outside of the second jaw, creating a region of high stress under load within the material of the second jaw. FIG. 9B shows a typical failure in the basic structure when a wrench of the prior art is inappropriately used as a crowbar—or when "too much" torque is applied. FIG. 9C illustrates a typical failure in the basic structure when a wrench of the prior art is inappropriately used as a hammer.

As described above, the strength of second jaw 18 of improved ratchetable open-ended wrench 1 of this invention is greatly increased by the structural integrity imparted to the second jaw due to the nature of its cover plates 23 and 25 and their relationship to second jaw 18. Wrench 1 shown in FIGS. 1, 2, and 3 and wrench 2 shown in FIG. 5, with the enhanced strength of second jaws 18 due to the nature of the structure, are much less likely to fail even if subjected to such misuse, and much higher torque can be applied without failure.

While the principles of this invention have been described in connection with specific embodiments, it should be understood clearly that these descriptions are made only by way of example and are not intended to limit the scope of the invention.

The invention claimed is:

1. In a ratchetable open-ended wrench for turning a rotatable element with a flat-to-flat dimension, the wrench having (1) first and second jaws, (2) a base area connecting the jaws, (3) a retractable jaw member slidable within a slot in the second jaw and projecting toward the base area, and (4) a first cover plate on a first side of the second jaw to limit the lateral movement of the retractable jaw member within the slot, the improvement wherein the cover plate is a load-bearing structural member within the second jaw by virtue of the cover plate being projection-welded tote second jaw on both sides of the slot by virtue of metal flow from projections on both sides thereof, whereby the cover plate serves the dual functions of providing encasement of the retractable jaw member and additional structural integrity to the second jaw.

2. The wrench of claim 1 further including:

the slot extending through the second jaw from the first side to a second side thereof;

a second cover plate projection-welded to the second side of the second jaw on both sides of the slot by virtue of metal flow from projections on both sides thereof such that both the first and second cover plates form load-bearing structural members within the second jaw.

3. The wrench of claim 1 wherein the cover plate is recessed in the second jaw such that the outer surface of the cover plate is substantially flush with the lateral surface of the second jaw.

4. The wrench of claim 1 wherein the retractable jaw member has an outer corner having a radius of at least 3% of the flat-to-flat dimension of the rotatable element for which the wrench is sized.

5. The wrench of claim 1 further including a full-compression oblong tapered coil spring for biasing the retractable jaw member toward the base area.

6. The wrench of claim 1 wherein the second jaw is shorter than the first jaw, whereby torque-related stresses within the material around the slot are reduced.

* * * * *

UNITED STATES PATENT AND TRADEMARK OFFICE

CERTIFICATE OF CORRECTION

PATENT NO. : 7,111,529 B2
APPLICATION NO. : 10/628037
DATED : September 26, 2006
INVENTOR(S) : Pradelski It is certified that error appears in the above-identified patent and that said Letters Patent is hereby corrected as shown below:

In column 6, line 45 delete “worm” and insert -- worn --;
In column 8, claim 1, line 1 delete “tote” and insert -- to the --.

Signed and Sealed this

Nineteenth Day of June, 2007

JON W. DUDAS
*Director of the United States Patent and Trademark Office*